US008049423B2

(12) United States Patent
Lee et al.

(10) Patent No.: US 8,049,423 B2
(45) Date of Patent: Nov. 1, 2011

(54) PLASMA DISPLAY PANEL WITH IMPROVED LUMINANCE AND LOW POWER CONSUMPTION

(75) Inventors: Chun-Gyoo Lee, Suwon-si (KR); Seong-Chan Bae, Suwon-si (KR); Sang-Hun Jang, Suwon-si (KR); Yong-Shik Hwang, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 155 days.

(21) Appl. No.: 12/458,799

(22) Filed: Jul. 23, 2009

(65) Prior Publication Data

US 2010/0019645 A1 Jan. 28, 2010

(30) Foreign Application Priority Data

Jul. 25, 2008 (KR) ..... 10-2008-0073212
Jun. 1, 2009 (KR) ..... 10-2009-0048235

(51) Int. Cl.
*H01J 61/35* (2006.01)

(52) U.S. Cl. ..... 313/587; 313/582; 313/586

(58) Field of Classification Search ..... 313/582–587
See application file for complete search history.

(56) References Cited

U.S. PATENT DOCUMENTS 6,160,345 A * 12/2000 Tanaka et al. ..... 313/489
6,255,780 B1 * 7/2001 Komaki et al. ..... 313/586
2005/0007308 A1 * 1/2005 Suzuki et al. ..... 345/60
2005/0242725 A1 * 11/2005 Hasegawa et al. ..... 313/582
2007/0114669 A1 5/2007 Park et al.
2007/0170950 A1 * 7/2007 Lee ..... 324/770
2007/0216305 A1 * 9/2007 Yeo ..... 313/582

FOREIGN PATENT DOCUMENTS

JP 2002-231129 A 8/2002
KR 10 2002-00657 A 8/2002
KR 10-2005-0122964 A 12/2005
KR 10-2007-0053889 A 5/2007
KR 10-2007-0078179 A 7/2007

OTHER PUBLICATIONS

Yasushi Motoyama, Invited Paper: SrCaO Protective Layer for High-Efficiency PDPs SID 06 Digest, pp. 1384-1387.
Korean Notice of Allowance in KR 10-2009-0048235, dated Jul. 18, 2011 (Lee, et al.).

* cited by examiner

*Primary Examiner* — Joseph L Williams
*Assistant Examiner* — Fatima N Farokhrooz
(74) *Attorney, Agent, or Firm* — Lee & Morse, P.C.

(57) ABSTRACT

A PDP includes a first substrate and a second substrate disposed to face each other, a plurality of address electrodes on the first substrate, a plurality of display electrodes on the second substrate, the display electrodes facing the first substrate and crossing the address electrodes, a first dielectric layer on the second substrate, the display electrodes being between the first dielectric layer and the second substrate, a first protective layer on the dielectric layer, the first protective layer including a low work function material, and a second protective layer on the first protective layer, the second protective layer including a high work function material and openings exposing the first protective layer in regions corresponding to the display electrodes.

20 Claims, 6 Drawing Sheets

(a)

(b)

(c)

PLASMA DISPLAY PANEL WITH IMPROVED LUMINANCE AND LOW POWER CONSUMPTION

BACKGROUND

1. Field

Example embodiments relate to a plasma display panel (PDP). More particularly, example embodiments relate to a PDP having high luminance and low power consumption.

2. Description of the Related Art

A PDP is a display device that may display an image by exciting phosphor with vacuum ultraviolet (VUV) rays generated by gas discharge in discharge cells. As the PDP enables a wide screen with a high resolution, it has been spotlighted as a future generation flat panel display.

For example, a conventional PDP, e.g., a three electrode surface-discharge type PDP, may include a front substrate with display electrodes, a rear substrate with address electrodes and positioned a predetermined distance from the front substrate, and a dielectric layer on the display electrodes. A space between the front substrate and the rear substrate may be partitioned with barrier ribs into a plurality of discharge cells, and a discharge gas may be injected into the discharge cells. A phosphor layer may be formed on the rear substrate.

A conventional dielectric layer may be covered with a protective layer to minimize impact of charged particles, e.g., minimize or prevent etching and removal of portions of the dielectric layer due to impact of ions during discharge and to prevent electrode short due to metallic material such as $Na^+$. The conventional protective layer may include MgO.

However, the conventional MgO protective layer may insufficiently reduce the discharge initiating voltage, thereby insufficiently reducing power consumption. Further, MgO may be relatively hygroscopic, thereby changing chromaticity of phosphor by the discharge sputtering and reducing luminance of the PDP.

SUMMARY

Embodiments are therefore directed to a PDP having improved luminance and low power consumption, which substantially overcome one or more of the problems due to the limitations and disadvantages of the related art.

It is therefore a feature of an embodiment to provide a PDP with a protective layer structure capable of increasing luminance and decreasing power consumption.

At least one of the above and other features and advantages may be realized by providing a PDP, including a first substrate and a second substrate disposed to face each other, a plurality of address electrodes formed on one surface of the first substrate, a first dielectric layer formed on the first substrate while covering the address electrodes, barrier ribs disposed in a space between the first substrate and the second substrate and partitioning a plurality of discharge cells, a phosphor layer formed in the discharge cells, a plurality of display electrodes disposed on one surface of the second substrate facing the first substrate in a direction crossing the address electrodes, a second dielectric layer formed on the second substrate while covering the display electrode, a first protective layer coating the second dielectric layer and including a low work function material, and a second protective layer formed on the first protective layer and including a high work function material, wherein the second protective layer is at least partially removed in a part corresponding to the display electrode where the discharge occurs.

The second protective layer may be in regions corresponding to a gap between adjacent display electrodes. The second protective layer may overlap only regions between adjacent display electrodes, regions between adjacent display electrodes extending between facing edges of adjacent transparent electrodes of respective display electrodes. The first protective layer may be between the first dielectric layer and the second protective layer. The second protective layer may include discontinuous portions on the first protective layer. The second protective layer may be a mono-crystalline layer. The low work function material of the first protective layer may have a work function of about 1 eV to about 4 eV. The low work function material of the first protective layer may include one or more of $Sr_{1-x}Ca_xO$ ($0<x<1$), SrO, CsO, CaO, ZnO, BaO, calcium aluminate, and combinations thereof. The second protective layer may include one or more of $SiO_2$, $TiO_2$, $Ta_2O_5$, $ZrO_2$, $Al_2O_3$, $MoO_2$, SiON, Si, $Si_3N_4$, a-SiO:H, a-$SiN_x$:H, a-Si:H, $AlF_3$, $BaF_2$, $B_2O_3$, $CaF_2$, $CaSiO_3$, $CeF_3$, $Na_5Al_3F_{14}$, $Na_3AlF_6$, LiF, $Li_2O$, $MgF_2$, KF, $Sc_2O_3$, NaCN, $V_2O_5$, $YF_3$, $GeO_2$, $Y_2O_3$, and combinations thereof. A work function difference between the low work function material of the first protective layer and the high work function material of the second protective layer may be about 1 eV or more. The work function difference between the low work function material and the high work function material may range from about 1 eV to about 5 eV.

The PDP may further include a third protective layer between the first protective layer and the first dielectric layer, the third protective layer including a high work function material. The third protective layer may have a thickness of about 10 nm to about 3000 nm. The first protective layer may have a higher secondary electron emission coefficient than the third protective layer. The first protective layer may have a thickness of about 300 nm to about 1000 nm. The second protective layer may have a thickness of about 5 nm to about 300 nm. The first protective layer may have a higher secondary electron emission coefficient than the second protective layer. The first protective layer may include a first portion overlapping the display electrodes and a second portion connected to the first portion, the first portion being thinner than the second portion. The first protective layer may include a first portion overlapping the display electrodes and a second portion connected to the first portion, the first protective layer further comprising a mixed portion on at least a part of the first portion, the mixed portion including the low work function material of the first protective layer and the high work function material of the second protective layer.

BRIEF DESCRIPTION OF THE DRAWINGS

The above and other features and advantages will become more apparent to those of ordinary skill in the art by describing in detail exemplary embodiments with reference to the attached drawings, in which.

DETAILED DESCRIPTION

Figure 1:
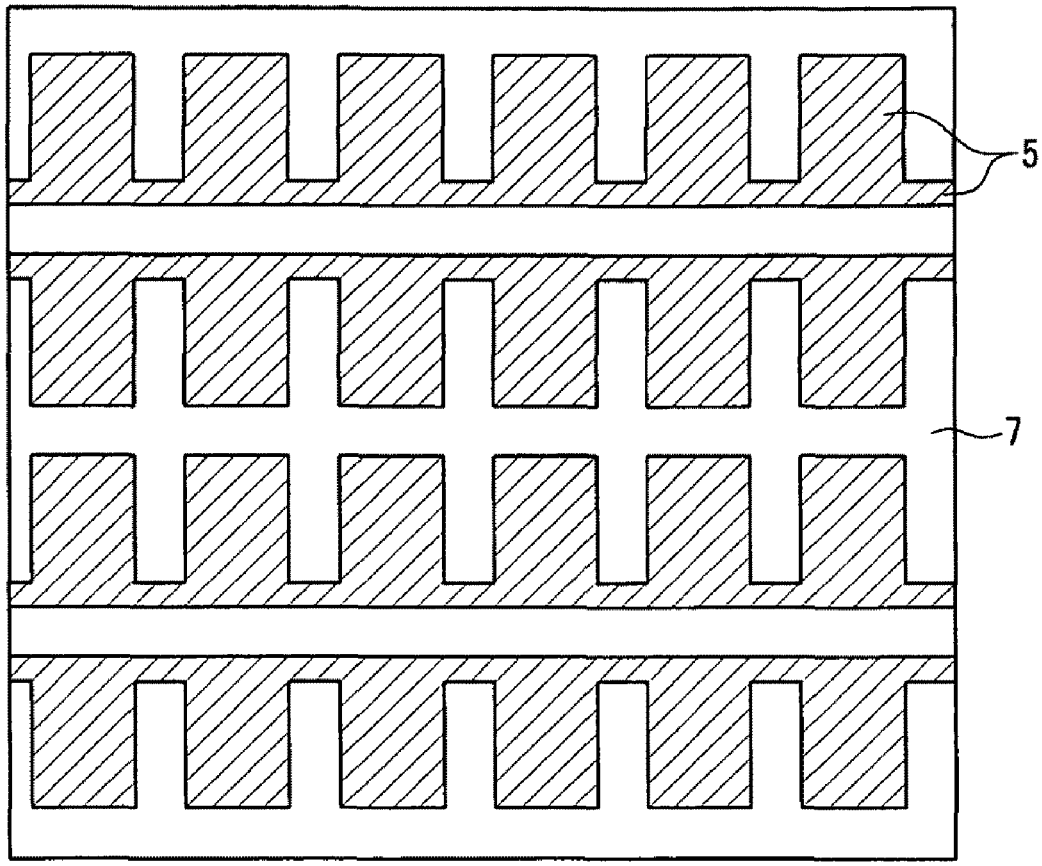
FIG. 1 illustrates a plan view of first and second protective layers in an upper panel of a PDP according to an embodiment.

Korean Patent Application Nos. 10-2008-0073212, filed on Jul. 25, 2008, and 10-2009-0048235, filed on Jun. 1, 2009, in the Korean Intellectual Property Office, are incorporated by reference herein in their entirety.

Provided is a PDP with a protective layer for protecting a dielectric layer therein. While a conventional PDP may include a MgO protective layer on a dielectric layer for protecting the dielectric layer, a PDP according to example embodiments may include a protective layer that provides reduced power consumption and increased luminance of the PDP, as compared to a PDP with the conventional MgO protective layer.

According to an example embodiment, a PDP may include a first substrate and a second substrate disposed to face each other, a plurality of address electrodes on the first substrate, barrier ribs disposed in a space between the first substrate and the second substrate and partitioning a plurality of discharge cells, a phosphor layer in the discharge cells, a plurality of display electrodes on the second substrate, and a dielectric layer covering the display electrodes. A first protective layer may be formed on the dielectric layer and the first protective layer includes of a low work function material, and a second protective layer may be formed on the first protective layer and the second protective layer includes a high work function material. In other words, the first protective layer may be between the dielectric layer and the second protective layer. Portions of the second protective layer may be removed to expose portions of the first protective layer in regions corresponding to the display electrodes.

In other words, the second protective layer may be only on first portions of the first protective layer, so second portions of the first protective layer may be exposed. For example, the second protective layer may be removed, e.g., completely removed, from the first protective layer in the part corresponding to the display electrodes, so the second protective layer may be on, e.g., only on, the part corresponding to the gap between adjacent display electrodes. In other words, the second protective layer may overlap the first protective layer only in a region between adjacent display electrodes, e.g., a region extending only between facing edges of adjacent display electrodes. In another example, the second protective layer may be partially present on the first protective layer in a part where the barrier rib is overlapped with the display electrode. In contrast, if the second protective layer is formed on the whole area corresponding to the display electrode, i.e., if the second protective layer covers the entire first protective layer, it may be difficult to achieve low voltage characteristics.

The second protective layer may be initially formed to cover the whole first protective layer in a substantially same procedure used to form the first protective layer during fabrication of the upper panel of the PDP. Subsequently, discharge sputtering may be generated during the process of aging, i.e., after assembling and sealing the PDP according to a general method by assembling the lower and upper panels. Due to the discharge sputtering, portions of the second protective layer may be removed, so the second protective layer may remain on, e.g., only on, a part corresponding to the gap between adjacent display electrodes. In contrast, when the second protective layer remains on the display electrodes, the first protective layer may not be sufficiently exposed to the discharge space, so it may be difficult to exhibit low voltage discharge characteristics.

According to an embodiment, the first protective layer may be formed of a low work function material. For example, the first protective layer may be formed of a material having a work function of about 1 eV to about 4 eV. Examples of low work function materials may include one or more of $Sr_{1-x}Ca_xO$ ($0<x<1$), SrO, CsO, CaO, ZnO, BaO, calcium aluminate, and combinations thereof. The low work function material may exhibit extraordinary merits in terms of life-span characteristics.

The first protective layer may have a thickness of about 300 nm to about 1000 nm, e.g., in a range from about 500 nm to about 800 nm. If the first protective layer has a thickness of less than about 300 nm, the thickness may be insufficient to protect the dielectric layer underneath. Therefore, the dielectric layer may be exposed to ion impact during the discharge, thereby causing poor discharge. If the first protective layer has a thickness of more than about 1000 nm, cracks may occur in the protective layer due to the thin film stress, and deposition duration of the protective layer may be increased, thereby deteriorating mass-productivity.

According to an embodiment, the second protective layer may be formed of a high work function material. The work function difference between the low work function material and the high work function material may be about 1 eV or more, e.g., the difference of work function may range from about 1 eV to about 5 eV.

According to an embodiment, the low work function material and the high work function material of the first and second protective layers, respectively, may have predetermined absorbing capacities to moisture ($H_2O$, $OH^-$) or $CO_2$. In particular, the absorbing capacity of the low work function material may be different than the absorbing capacity of the high work function material by about two or more times. More particularly, as the low work function material has high reactivity, i.e., so as to easily react with other materials, it may have an excellent absorbing capacity to moisture or $CO_2$. Accordingly, the low work function material may have higher absorbing capacity than that of the high work function material, e.g., the low work function material may have higher absorbing capacity than that of the high work function by about 2 times to about 500 times.

The high work function material of the second protective layer may include, e.g., one or more of $SiO_2$, $TiO_2$, $Ta_2O_5$, $ZrO_2$, $Al_2O_3$, $MoO_2$, SiON, Si, $Si_3N_4$, a-SiO:H, a-$SiN_x$:H, a-Si:H, MgO, $AlF_3$, $BaF_2$, $B_2O_3$, $CaF_2$, $CaSiO_3$, $CeF_3$, $Na_5Al_3F_{14}$, $Na_3AlF_6$, LiF, $Li_2O$, $MgF_2$, KF, $Sc_2O_3$, NaCN, $V_2O_5$, $YF_3$, $GeO_2$, $Y_2O_3$, and combinations thereof. For example, the high work function material may be a monocrystalline material and may be effectively capable of capping the low work function material that is multi-crystalline, e.g., relative to a conventional protective layer including multi-crystalline MgO. For example, the high work function material may have a higher sputtering yield than that of MgO, so the high work function material, i.e., of the second protective layer, may be effectively removed from predetermined portions of the lower work function material, e.g., from portions of the first protective layer corresponding to the display electrodes. As the high work function material has a high work function, it may have a low reactivity, excellent transmittance in visible light region, and a low thin film density, and it may be readily deposited as a thin film. In addition, as the high work function material has a low secondary electron emission coefficient, it may have a high discharge voltage and may be capable of inhibiting the discharge. When the second protective layer formed with the high work function material is present only in the part corresponding to the gap between adjacent display electrodes, it may be possible to prevent or substantially minimize discharge from sputtering in non-active parts and decreasing current so as to increase efficiency. It may be possible to emit the secondary electrons by using the low work function material between the dielectric layer and the second protective layer formed with the high work function material and to decrease the discharge initiating voltage.

According to an embodiment, the second protective layer may have a thickness of about 5 nm to about 300 nm, e.g., in a range from about 10 nm to about 100 nm. When the second protective layer has a thickness of less than about 5 nm, the thickness may be insufficient to cap the first protective layer. When the second protective layer has a thickness of more than about 300 nm, it may be difficult to remove portions of the second protective layer during discharge of the PDP, resulting in suppression of performance of the first protective layer.

The PDP according to an embodiment may further include a third protective layer under the first protective layer while covering the dielectric layer, e.g., the first protective layer may be between the third and second protective layers. The third protective layer may include a high work function material, e.g., a substantially same material s the second protective layer. The third protective layer may prevent or substantially minimize contamination of the first protective layer. Generally, a contaminant, e.g., impurity or remaining carbon components generated from the dielectric layer, may contaminate the first protective layer, e.g., during a heat sealing process at a high temperature of about 480° C., after depositing the first protective layer. According to an example embodiment, deposition of the third protective layer between the first protective layer and the dielectric layer may reduce contamination during the heat sealing process. In addition, the third protective layer may improve the adhesive strength between the first protective layer and the dielectric layer, and may reduce the thin film stress of the first protective layer.

According to an embodiment, the third protective layer may have a thickness of about 10 nm to about 3000 nm. When the third protective layer has a thickness in the above-specified range, it may be possible to prevent the first protective layer from being contaminated. In addition, thin film stress and discharge voltage variation may be reduced, so the peeling off of the first protective layer may be prevented or substantially minimized, and mass productivity may not be deteriorated.

According to an embodiment, the first protective layer may have a higher secondary electron emission coefficient than that of the second or third protective layer. A difference between the secondary electron emission coefficient of the first protective layer and the secondary electron emission coefficient of the second or third protective layer may be about 0.1 to about 0.6 when Ne+ ions are accelerated at 150 eV. When the difference of secondary electron emission coefficients is within the range of about 0.1 to about 0.6, discharge voltage may be decreased and the VUV radiation amount may be increased.

As discussed previously, the second protective layer may be initially formed to cover the entire first protective layer by a substantially same process used to form the first protective layer. Since the first protective layer is covered by the second protective layer, reactivity of the first protective layer with water and carbon oxide may be prevented or substantially minimized. Portions of the initially formed second protective layer may be removed by sputtering during aging of the PDP, i.e., after sealing of the PDP, so the second protective layer may remain, e.g., only, between adjacent display electrodes. Further, the first protective layer may be exposed through the second protective layer in regions corresponding to the display electrodes after sealing of the PDP, so reactivity of the first protective layer with moisture and/or carbons oxide may be prevented or substantially minimized.

The material for the second protective layer may penetrate, i.e., diffuse into, the first protective layer, so the first protective layer on, e.g., directly on, the display electrodes may include a high work function material in addition to the low work function material. The high and low function materials in the first protective layer, i.e., due to penetration of the high function material into the first protective layer, may interact to form a compound since the temperature is increased by the ion impact during discharging of the PDP. The resultant compound may be present at an interface between the first and second protective layers. The resultant compound may be prepared and may be present in the interface between the first and second protective layers during the heat sealing process.

During the aging process, a portion of the first protective layer provided on the display electrode may be partially removed to reduce a thickness of the first protective layer. Therefore, a portion of the first protective layer directly on the display electrodes may be thinner than a portion of the first protective layer directly on the second protective layer. The thickness of first protective layer may be reduced by about 5 nm to about 500 nm.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 2:
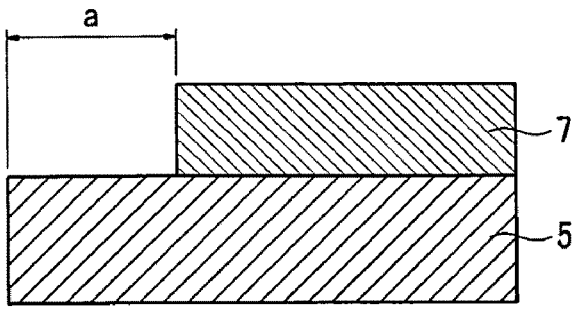
FIG. 2 illustrates a cross-sectional view of the PDP in FIG. 1.
Figure 9:
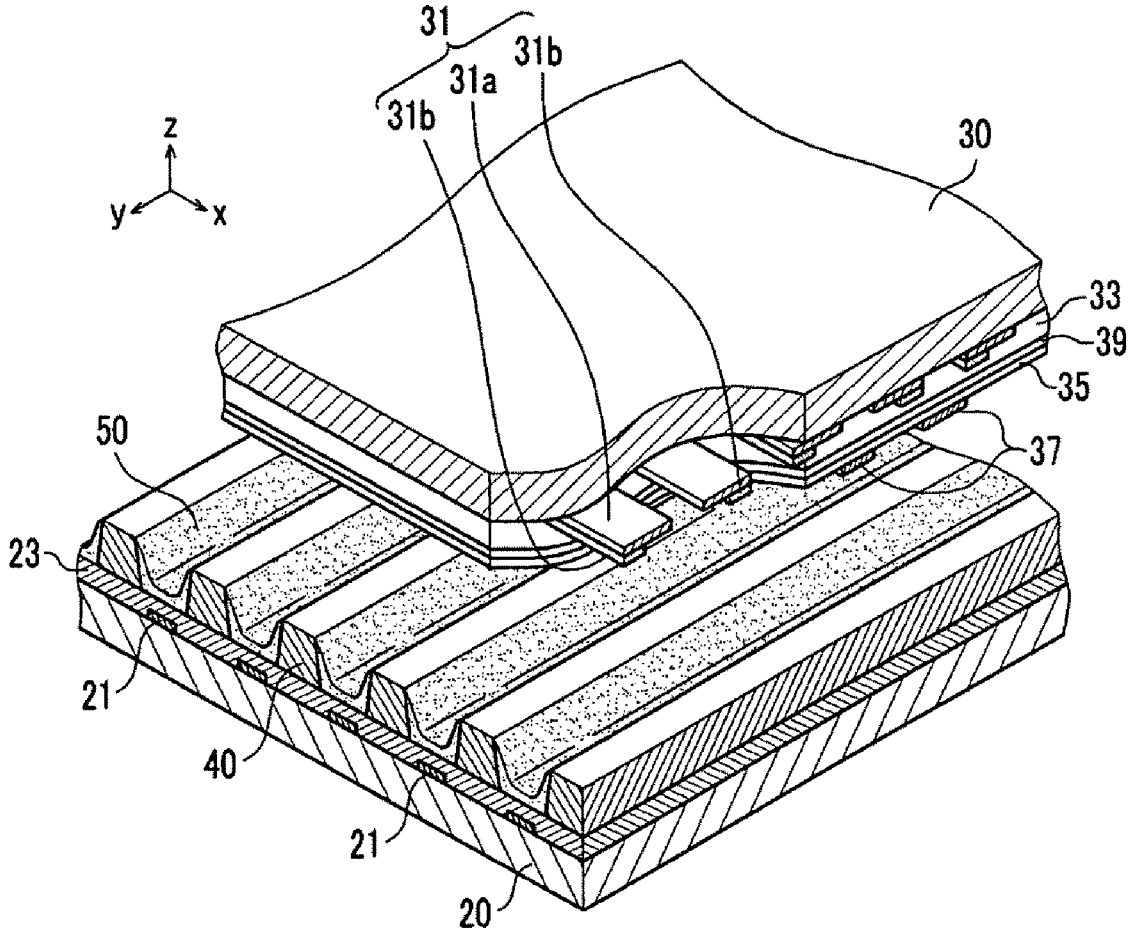
FIG. 9 illustrates a perspective view of a PDP according to an example embodiment.

FIG. 9 illustrates a perspective view of a PDP according to an example embodiment. FIG. 1 illustrates a plan view of an upper panel of the PDP of FIG. 9 as viewed along a direction oriented from a discharge space toward an upper substrate, i.e., a second substrate. In particular, FIG. 1 illustrates a relative configuration of first and second protective layers. FIG. 2 illustrates a partial cross-section of the relative configuration of the first and second protective layers in FIG. 1.

Referring to FIGS. 1 and 9, a PDP according to an example embodiment may include a first substrate 20 and a second substrate 30 disposed to face each other, a plurality of address electrodes 21 formed on one surface of the first substrate 20, a first dielectric layer 23 formed on the first substrate 20 to cover the address electrodes 21, barrier ribs 40 in a space between the first substrate 20 and the second substrate 30 to partition a plurality of discharge cells, and a phosphor layer 50 formed in the discharge cells. The PDP may further include a plurality of display electrodes 31 disposed on one surface of the second substrate 30, so the display electrodes 31 may be between the first substrate 20 and the second substrate 30 and may be oriented in a direction crossing the address electrodes 21. A second dielectric layer 33 may be formed on the second substrate 30 to cover the display electrode 31. Further, a first protective layer 5 and a second protective layer 7 may be sequentially formed on the second dielectric layer 33. The first protective layer 5 may be between the second dielectric layer 33 and the second protective layer 7, so the second protective layer 7 may face the discharge space between the first and second substrates 20 and 30.

The first protective layer 5 may cover the entire second substrate 30, and may be the first protective layer discussed previously. The second protective layer 7 may be the second protective layer discussed previously, so the second protective layer 7 may be initially formed to overlap the entire first protective layer 5, followed by partial removal of portions of the second protective layer 7. In other words, portions of the second protective layer 7 may be removed, e.g., the second protective layer 7 may include a plurality of discontinuous discrete segments, to expose the first protective layer 5, e.g., portions of the second protective layer 7 may be removed only in parts corresponding to the display electrodes 31 where discharge occurs by sputtering when the PDP is subjected to an aging process. Therefore, the first protective layer 5 on, e.g., directly on, a bus electrode 31*b* and a transparent electrode 31*a* of the display electrodes may be exposed to the discharge space, while regions of the first protective layer 5 between adjacent display electrodes 31, i.e., regions corresponding to a gap between adjacent display electrodes 31, may not be exposed and may be covered with the second protective layer 7.

For example, as illustrated in FIG. 1, portions of the second protective layer 7 may be removed, so an outline of the first protective layer 5 exposed through the removed portions of the second protective layer 7 may have a shape of linear bus electrodes with transparent electrodes extending therefrom. The outline of the first protective layer 5 exposed through the removed portions of the second protective layer 7 and the display electrodes 31 may overlap, e.g., completely overlap, each other. As further illustrated in FIG. 1, the second protective layer 7 remaining on the first protective layer 5 may be in regions, e.g., only in regions, not overlapping the display electrodes 31. For example, as illustrated in FIG. 1, the second protective layer 7 may include first linear portions in gaps between adjacent bus electrodes 31*b* and second linear portions substantially perpendicular to the first linear portions in gaps between adjacent transparent electrodes 31*a*.

In order to clearly illustrate the positions of the first and second protective layers 5 and 7 according to one embodiment, FIG. 2 illustrates a cross sectional view thereof. As illustrated in FIG. 2, the second protective layer 7 may be formed on the first protective layer 5, and a portion of the second protective layer 7 may be removed from region "a" of the first protective layer 5. Region "a" may correspond to a region of the first protective layer 5 overlapping the display electrodes 31. According to one embodiment, a thickness of the second protective layer 7 may be substantially equal to or less than a thickness of the first protective layer 5. For example, the second protective layer 7 may have a thickness of about 5 nm to about 300 nm, and the first protective layer 5 may have a thickness of about 300 nm to about 1000 nm. If the second protective layer 7 has a smaller thickness than the first protective layer 5, supply of electrons emitted from the first protective layer 5 to the discharge space may be facilitated.

Figure 3:
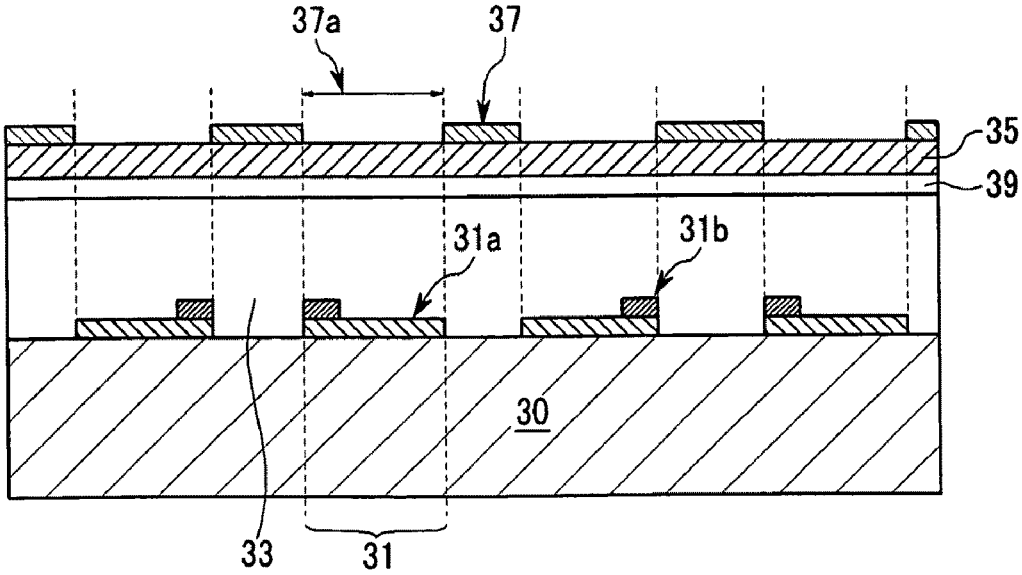
FIG. 3 illustrates a schematic cross-sectional view of an upper panel with first and second protective layers of a PDP according to another embodiment.

FIG. 3 illustrates a cross-sectional view of an upper panel of a PDP according to another embodiment. As illustrated in FIG. 3, the display electrodes 31 including a pair of a transparent electrode 31*a* and a bus electrode 31*b* may be formed on the second substrate 30, and the second dielectric layer 33 may be disposed on the whole second substrate 30 to cover the display electrodes 31. A second protective layer 37 may be formed on a first protective layer 35 only at regions corresponding to a gap between the display electrodes 31, and a third protective layer 39 may be formed under the first protective layer 35 while covering the second dielectric layer 33. The third protective layer 39 may be between the second dielectric layer 33 and the first protective layer 35, and may be the third protective layer described previously. The third protective layer 39 and the first protective layer 35 may completely overlap each other. The first and second protective layers 35 and 37 may be substantially the same as the first and second protective layers 5 and 7, respectively, described previously with reference to FIGS. 1, 2, and 9. As illustrated in FIG. 3, the portions removed from the second protective layer 37 may define openings 37*a* in the protective layer 37, e.g., the openings 37*a* may overlap the display electrodes 31.

Figure 4:
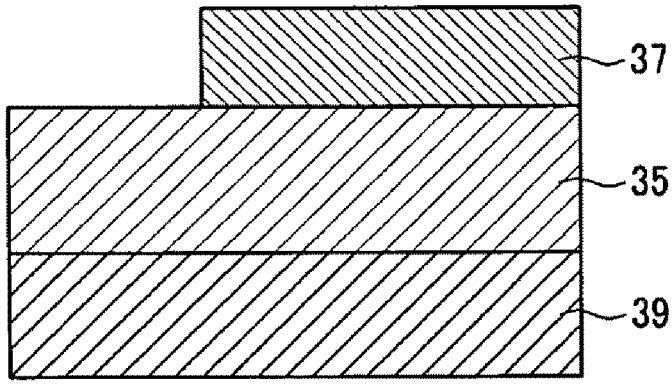
FIG. 4 illustrates a cross-sectional view of the PDP in FIG. 3.

In order to clearly illustrate the position of first to third protective layers 35, 37, and 39 in FIG. 3, FIG. 4 illustrates only the structure of the first to third protective layers 35, 37, and 39. As illustrated in FIG. 4, the second protective layer 37 may be disposed on the first protective layer 35, and the third protective layer 39 may be disposed under the first protective layer 35.

According to an embodiment, the first protective layer 35 may have a thickness of about 300 nm to about 1000 nm, the second protective layer 37 may have a thickness of about 5 nm to about 300 nm, and the third protective layer 39 may have a thickness of about 10 nm to about 3000 nm.

Figure 5:
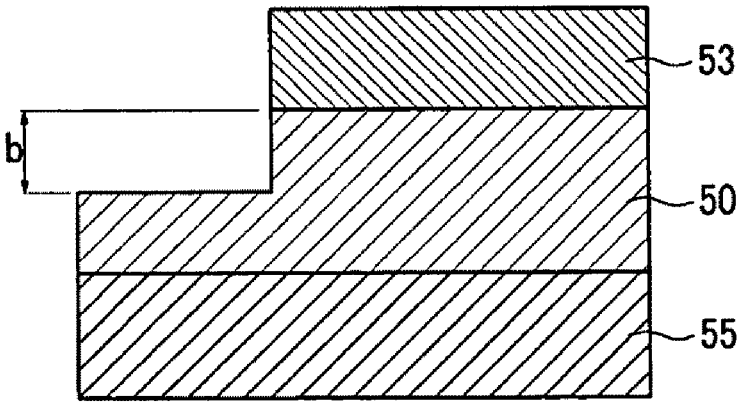
FIG. 5 illustrates a schematic cross-sectional view of a structure of protective layers according to another embodiment.

FIG. 5 illustrates a structure of first to third protective layers of a PDP according to another embodiment. As illustrated in FIG. 5, a second protective layer 53 may be disposed on a first protective layer 50, and a third protective layer 55 may be disposed under the first protective layer 50. In other words, the first protective layer 50 may be between the second and third protective layers 53 and 55. The second and third protective layers 53 and 55 may be the same as the second and third protective layer 37 and 39, respectively, discussed previously with reference to FIGS. 3 and 4. As illustrated in FIG. 5, the first protective layer 50 may be partially removed. In other words, a portion of the first protective layer 50 disposed over the display electrodes may be partially removed to a predetermined depth, so a thickness of the first protective layer 50 in a region overlapping the display electrodes may be reduced by a thickness "b." The thickness "b" of the removed first protective layer 50 may range from about 5 nm to about 500 nm.

The first protective layer 50 under the second protective layer 53 may have a thickness of about 300 nm to about 1000 nm. Therefore, a thickness of the first protective layer 50 in a region overlapping the display electrodes may be reduced by a thickness "b" relative to about 300 nm to about 1000 nm.

Figure 6:
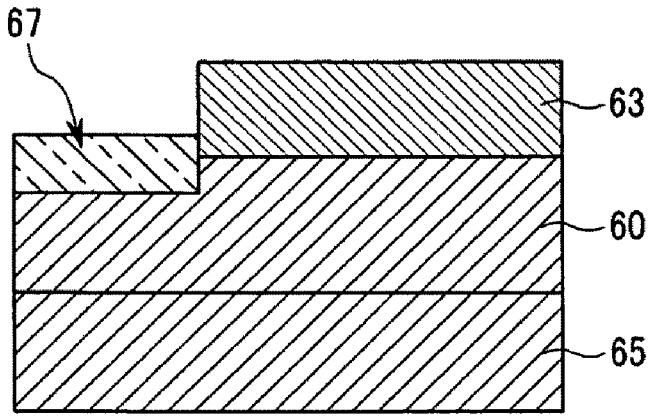
FIG. 6 illustrates a cross-sectional view of protective layers according to another embodiment.

FIG. 6 illustrates a structure of first to third protective layers of a PDP according to yet another embodiment. As illustrated in FIG. 6, a second protective layer 63 may be disposed on a first protective layer 60, and a third protective layer 65 may be disposed under the first protective layer 60. The protective layers of the PDP in FIG. 6 may be substantially the same as the protective layers described previously with reference to FIGS. 1-5, with the exception of including a region 67. In particular, a material for the second protective layer 63 may diffuse into a portion of the first protective layer 60 to form a mixed region 67, e.g., at an interface between the first and second protective layer 60 and 63. For example, as illustrated in FIG. 6, after a thickness of the first protective layer 60 is reduced by a thickness "b," the first protective layer 60 formed on the part corresponding to the display electrode may have a region 67 that includes a compound material of the first and second protective layers 60 and 63.

The following examples illustrate example embodiments in more detail. The following examples are merely specific examples and do not limit the scope of the example embodiments.

Example 1

A transparent electrode was formed on a front substrate of soda lime glass by using an indium tin oxide conductor material. A bus electrode was formed on the transparent electrode by using a composition for forming a bus electrode, i.e., a composition including Ag, to provide a display electrode including the transparent electrode and the bus electrode in accordance with a general process.

Subsequently, a composition for a dielectric layer including a glass powder of PbO—$B_2O_3$—$SiO_2$ was coated on the whole surface of the front substrate to cover the display electrode. The composition for the dielectric layer on the substrate was baked to provide a dielectric layer.

$Sr_{1-x}Ca_xO$ (x=0.38) was deposited on the dielectric layer by electron beam deposition to form a first protective layer having a thickness of 800 nm. Then, $SiO_2$ was deposited on the first protective layer by electron beam deposition to form a second protective layer having a thickness of 30 nm. The $Sr_{1-x}Ca_xO$ (x=0.38) had a work function of 1.5 eV and a secondary electron emission coefficient of 0.5, and the $SiO_2$ had a work function of 5 eV and a secondary electron emission coefficient of 0.1.

The obtained product was measured in a depth direction from $SiO_2$ of the second protective layer using SIMS (Secondary Ion Mass Spectrometry) to determine a relative strength of each element. The results showed that OH strength of the first protective layer, i.e., $Sr_{1-x}Ca_xO$ (x=0.38), was higher by about 300 times than that of the second protective layer, i.e., $SiO_2$. Further, the results showed that C of the first protective layer, i.e., $Sr_{1-x}Ca_xO$ (x=0.38), was higher by about 10 times than that of the second protective layer, i.e., $SiO_2$ layer.

From the results, it is understood that the moisture absorbing capacity of the first protective layer, i.e., the $Sr_{1-x}Ca_xO$ (x=0.38) layer, was higher by about 300 times than that of the second protective layer, i.e., the $SiO_2$ layer. Similarly, the $CO_2$ absorbing capacity of the first protective layer, i.e., the $Sr_{1-x}Ca_xO$ (x=0.38) layer, was higher by about 10 times than that of the second protective layer, i.e., the $SiO_2$ layer.

In addition, water solubility of the first protective layer, i.e., the $Sr_{1-x}Ca_xO$ (x=0.38) layer, was 8 g/100 ml. Water solubility of the second protective layer, i.e., the $SiO_2$ layer, was around 0.012 g/100 ml.

Comparative Example 1

A PDP panel was prepared as described in Example 1, with the exception of forming no protection layer on the dielectric layer.

Comparative Example 2

A PDP panel was prepared as described in Example 1, with the exception of forming only a $Sr_{1-x}Ca_xO$ (x=0.38) layer to a thickness of 800 nm, i.e., without forming a $SiO_2$ layer on the $Sr_{1-x}Ca_xO$ (x=0.38) layer.

Comparative Example 3

A PDP panel was prepared as described in Example 1, with the exception of forming a MgO layer as a second protective layer instead of a $SiO_2$ layer. In other words, a MgO layer was formed on the $Sr_{1-x}Ca_xO$ (x=0.38) layer to a thickness of 30 nm.

Each PDP obtained from Example 1 and Comparative Examples 1-2 was measured to determine luminous efficiency by varying the sustain voltage. Results are shown in FIG. 7.

Figure 7:
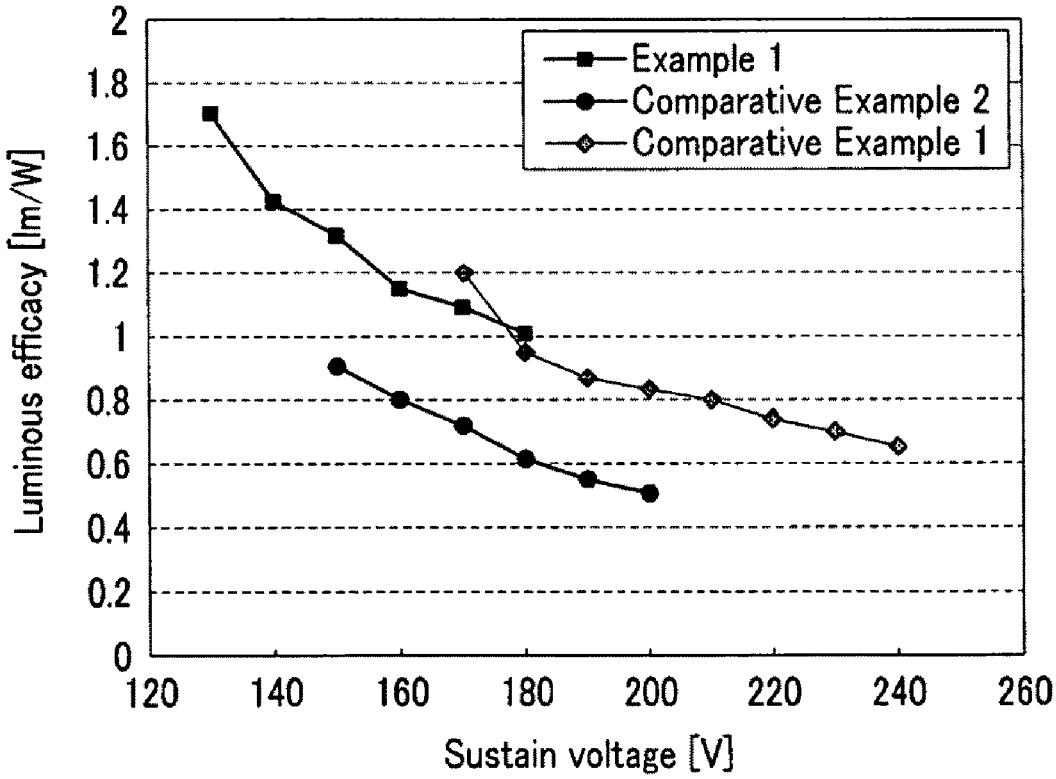
FIG. 7 illustrates a graph of luminous efficiency with respect to voltage of each PDP obtained from Example 1 and Comparative Examples 1 and 2.

As illustrated in FIG. 7, the PDP according to Example 1, i.e., a PDP including a $Sr_{1-x}Ca_xO$ (x=0.38) layer and a $SiO_2$ layer as protective layers, showed high luminous efficiency even at a low sustain voltage, so it is anticipated to show low voltage discharge. On the other hand, it is confirmed that the PDP according to Comparative Examples 1-2 showed lower luminous efficiency than the PDP of Example 1. In fact, the PDP in Comparative Example 2, i.e., a PDP including only a $Sr_{1-x}Ca_xO$ (x=0.38) layer as a protective layer, showed lower luminous efficiency than Comparative Example 1, i.e., a PDP including no protective layer. In this regard, it is noted that while SrCaO may have high efficiency, SrCaO has high reactivity to $H_2O$ or $CO_2$, thereby failing to maintain good film characteristics when exposed to air during processing.

SEM photographs were obtained of each protective layer in Example 1 and Comparative Examples 2-3. The SEM photographs are illustrated in FIG. 8(*b*), FIG. 8(*a*), and FIG. 8(*c*), respectively.

Figure 8:
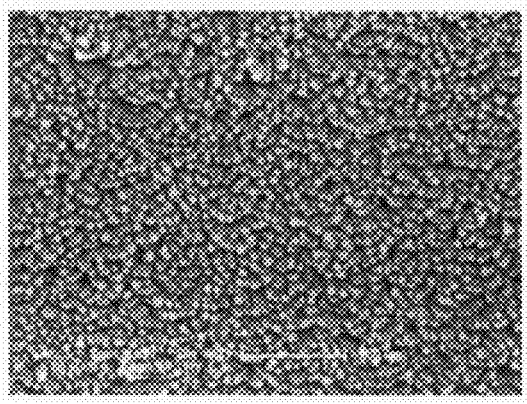
FIG. 8 illustrates a SEM photograph of each protective layer obtained from Example 1 and Comparative Examples 2 and 3.
Figure 8:
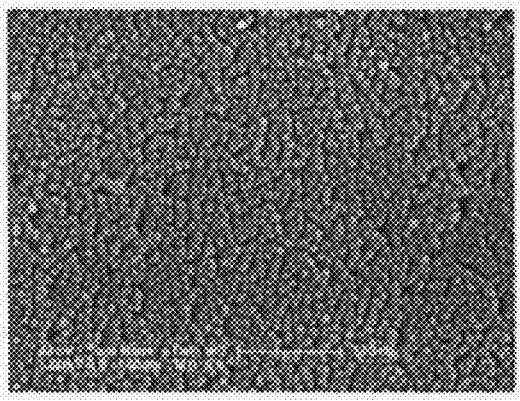
Figure 8:
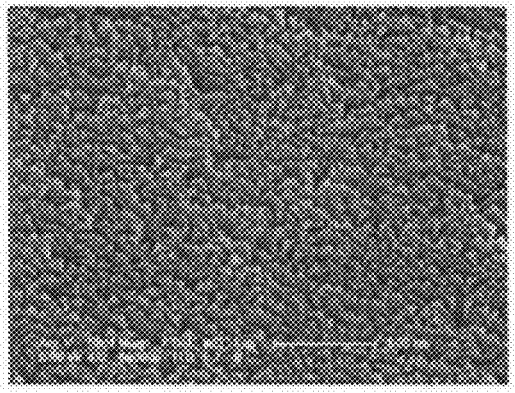

As illustrated in FIG. 8(*a*), the $Sr_{1-x}Ca_xO$ (x=0.38) protective layer obtained from Comparative Example 2 showed a multi-crystalline grown surface at which the crystal was roughly grown. Therefore, it is understood that the $Sr_{1-x}Ca_xO$ (x=0.38) protective layer had high surface roughness.

As illustrated in FIG. 8(*b*), the second protective layer of Example 1, i.e., the $SiO_2$ second protective layer was an amorphously grown thin film on the first protective layer of $Sr_{1-x}Ca_xO$ (x=0.38), had an excellent step coverage which is a surface roughness. In other words, the $SiO_2$ layer uniformly capped the surface of the $Sr_{1-x}Ca_xO$ (x=0.38) layer. Therefore, it is anticipated that the second protective layer, i.e., the $SiO_2$ layer, could effectively prevent the first protective layer, i.e., the $Sr_{1-x}Ca_xO$ (x=0.38) layer, from reacting directly with the external moisture or $CO_2$.

As illustrated in FIG. 8(*c*), in Comparative Example 3, the second protective layer of MgO was formed on the first protective layer of $Sr_{1-x}Ca_xO$ (x=0.38). Since both $Sr_{1-x}Ca_xO$ (x=0.38) and MgO layers were multi-crystalline, it was impossible to uniformly cap the rough surface of the first protective layer with the second protective layer. Therefore, the second protective layer still had a rough surface. Accordingly, it is anticipated that a multi-crystalline MgO cannot effectively cap an underlying layer, i.e., small portions of the first protective layer may still be exposed to external environment, e.g., moisture, during processing due to the rough surface of the MgO. Thus, the MgO layer cannot prevent or minimize direct interaction of the first protective layer with external moisture or $CO_2$.

According to example embodiments, a PDP may include first and second protective layers. The first protective layer may include a high efficiency material for protecting a dielectric layer, and the second protective layer may suppress reactivity of the high efficiency material in the first protective layer. Therefore, it may be possible to economically provide a PDP with high luminance and low power consumption. For example, by depositing the second protective layer on a SrCaO layer, i.e., a first protective layer including a material having a high reactivity with water and carbon oxide, a resultant PDP may have improved luminance and power consumption. Further, it may not be required to process the SrCaO layer via sealing and exhausting under vacuum or an inert atmosphere, which may be substantially impossible to perform because of prohibitive cost in the production line, for reduced reactivity thereof.

Exemplary embodiments have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A plasma display panel (PDP), comprising:

a first substrate and a second substrate disposed to face each other;

a plurality of address electrodes on the first substrate;

a plurality of display electrodes on the second substrate, the display electrodes facing the first substrate and crossing the address electrodes;

a first dielectric layer on the second substrate, the display electrodes being between the first dielectric layer and the second substrate;

a first protective layer on the first dielectric layer, the first protective layer including a low work function material; and a second protective layer on the first protective layer, the second protective layer including a high work function material and openings exposing the first protective layer in regions corresponding to the display electrodes.

2. The PDP as claimed in claim 1, wherein the second protective layer is in regions between adjacent display electrodes.

3. The PDP as claimed in claim 1, wherein the first protective layer is between the first dielectric layer and the second protective layer.

4. The PDP as claimed in claim 1, wherein the second protective layer includes discontinuous portions on the first protective layer.

5. The PDP as claimed in claim 1, wherein the second protective layer is a mono-crystalline layer.

6. The PDP as claimed in claim 1, further comprising:

a second dielectric layer on the first substrate to cover the address electrodes;

barrier ribs between the first substrate and the second substrate, the barrier ribs partitioning a plurality of discharge cells; and a phosphor layer in the discharge cells.

7. The PDP as claimed in claim 1, wherein the low work function material of the first protective layer has a work function of about 1 eV to about 4 eV.

8. The PDP as claimed in claim 1, wherein the low work function material of the first protective layer includes one or more of $Sr_{1-x}Ca_xO$ ($0<x<1$), SrO, CsO, CaO, ZnO, BaO, calcium aluminate, and combinations thereof.

9. The PDP as claimed in claim 1, wherein the high work function material of the second protective layer includes one or more of $SiO_2$, $TiO_2$, $Ta_2O_5$, $ZrO_2$, $Al_2O_3$, $MoO_2$, SiON, Si, $Si_3N_4$, a-SiO:H, a-$SiN_x$:H, a-Si:H, $AlF_3$, $BaF_2$, $B_2O_3$, $CaF_2$, $CaSiO_3$, $CeF_3$, $Na_5Al_3F_{14}$, $Na_3AlF_6$, LiF, $Li_2O$, $MgF_2$, KF, $Sc_2O_3$, NaCN, $V_2O_5$, $YF_3$, $GeO_2$, $Y_2O_3$, and combinations thereof.

10. The PDP as claimed in claim 1, wherein a work function difference between the low work function material of the first protective layer and the high work function material of the second protective layer is about 1 eV or more.

11. The PDP as claimed in claim 1, further comprising a third protective layer between the first protective layer and the first dielectric layer, the third protective layer including a high work function material.

12. The PDP as claimed in claim 1, wherein the first protective layer has a thickness of about 300 nm to about 1000 nm.

13. The plasma display panel as claimed in claim 1, wherein the second protective layer has a thickness of about 5 nm to about 300 nm.

14. The PDP as claimed in claim 1, wherein the first protective layer has a higher secondary electron emission coefficient than the second protective layer.

15. The PDP as claimed in claim 1, wherein the first protective layer includes a first portion overlapping the display electrodes and a second portion connected to the first portion, the first portion being thinner than the second portion.

16. The PDP as claimed in claim 1, wherein the first protective layer includes a first portion overlapping the display electrodes and a second portion connected to the first portion, the first protective layer further comprising a mixed portion on at least a part of the first portion, the mixed portion including the low work function material of the first protective layer and the high work function material of the second protective layer.

17. The PDP as claimed in claim 2, wherein the second protective layer overlaps only regions between adjacent display electrodes, the regions between adjacent display electrodes extending between facing edges of adjacent transparent electrodes of respective display electrodes.

18. The PDP as claimed in claim 10, wherein the work function difference between the low work function material and the high work function material ranges from about 1 eV to about 5 eV.

19. The PDP as claimed in claim 11, wherein the third protective layer has a thickness of about 10 nm to about 3000 nm.

20. The PDP as claimed in claim 11, wherein the first protective layer has a higher secondary electron emission coefficient than the third protective layer.

* * * * *